United States Patent [19]

Orpaz

[11] Patent Number: 5,013,320

[45] Date of Patent: May 7, 1991

[54] PACIFIER WITH LIP CLIP

[76] Inventor: Roni Orpaz, 128 Renov Ahad Ha'am, Tel Aviv, Israel

[21] Appl. No.: 470,608

[22] Filed: Jan. 29, 1990

[51] Int. Cl.[5] ..... A61J 17/00

[52] U.S. Cl. ..... 606/234; D24/45

[58] Field of Search ..... 606/234–236; 604/77, 79; D24/45, 46

[56] References Cited

U.S. PATENT DOCUMENTS

| | | | |
|---|---|---|---|
| D. 276,939 | 12/1984 | Pascoe | D24/46 |
| 1,207,120 | 12/1916 | Younker | 606/234 X |
| 3,130,725 | 4/1964 | Griesinger | 606/236 X |
| 3,601,129 | 2/1969 | Seidl | 606/236 |
| 3,946,736 | 3/1976 | Neward | 604/79 X |

FOREIGN PATENT DOCUMENTS

| | | | |
|---|---|---|---|
| 0079497 | 7/1955 | Denmark | 606/234 |
| 0279095 | 3/1952 | Switzerland | 606/236 |

*Primary Examiner*—John D. Yasko
*Assistant Examiner*—Adam J. Cermak
*Attorney, Agent, or Firm*—Fleit, Jacobson, Cohn, Price, Holman & Stern

[57] ABSTRACT

The present invention involves a standard pacifier, which pacifier includes a nipple, protection disc and gripping handle, and an improvement of the pacifier. A clip is provided on the protection disc of the pacifier for securing the pacifier to the lip of the user. The clip may take a variety of forms, the common feature being that the clip is made of a ¾ (270°) ring, and is preferably part of the protection disc.

3 Claims, 1 Drawing Sheet

PACIFIER WITH LIP CLIP

The present invention relates to babie's dummies (pacifiers).

The use of dummies commenced years ago and to this date apart from slight changes in configuration and material basically it remained the same for obvious reasons.

It is a well known fact that from time to time the baby rejects the pacifier and starts to cry. Sometime the pacifier just drops out of the baby's mouth, but still the result is the same. It can be really said that there are no means for keeping the pacifier in a baby's mouth or keeping it from falling out.

It is thus the object of the present invention to provide pacifiers with means which will keep the pacifier insider the baby's mouth or which will prevent it from falling out.

According to the invention there is provided a baby's pacifier which at one end of the portion held within the baby's mouth and integral with the protection disc which prevents the swallowing of the pacifier, there is provided a clip in the form of substantially ¾ (270°) of a ring which clip is placed on the lower lip of the baby and which prevents the dropping out thereof, the said ring shaped clip extending in a plane normal to that of the said disc.

The invention will now be described with reference to the annexed drawings in which.

Figure 1:
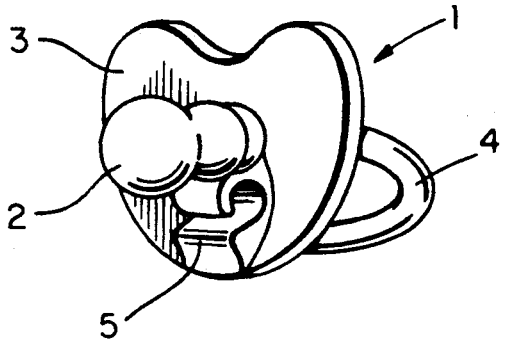
FIG. 1 is a perspective illustration of a pacifier.

Turning first to FIG. 1 a conventional pacifier 1 has a mouth piece 2, a protection disc 3 and gripping handle 4 and the new clip 5.

Figure 2:
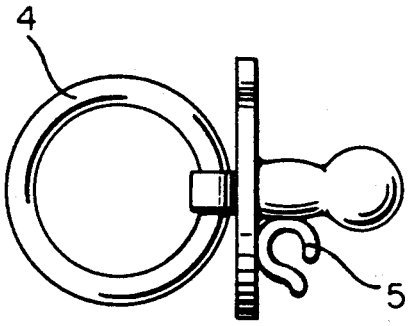
FIGS. 2, 3 and 4 are different embodiments of the clip.
Figure 3:
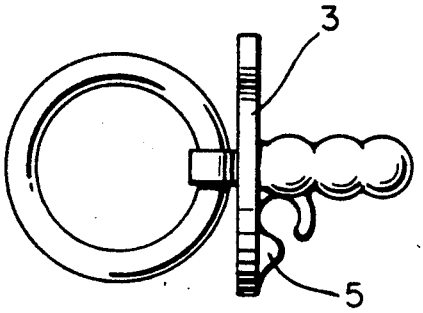

FIGS. 2 and 3 illustrate two different types of pacifier provided with two embodiments of clips which for all practical purposes function in the same manner.

Figure 4:
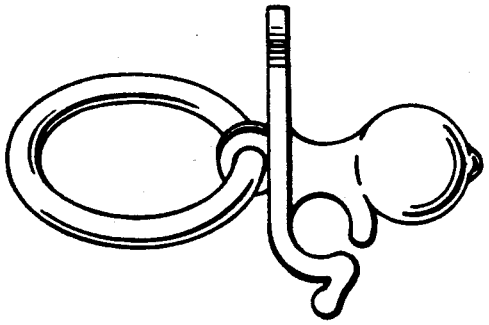
Figure 5:
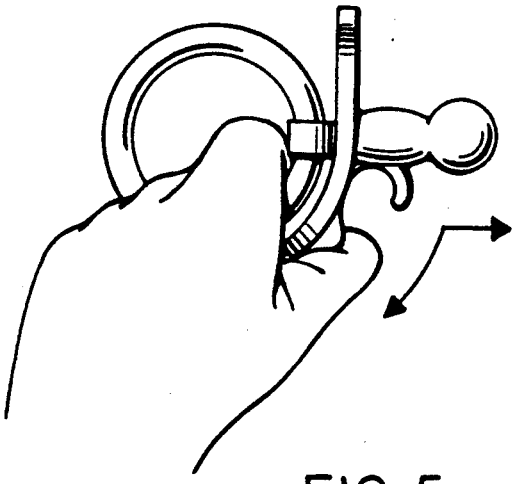
FIG. 5 illustrates the manner in which the clip is used.

As can be seen in FIG. 4 the pacifier is held in one hand of a person while the thumb is pulling back the protection disc 3 which causes the partial ring of the clip to open permitting the entrance of the lower lip of the baby (FIG. 5) into the space defined by the confines of the said clip.

Due to the fact that the clip does not constitute a rull ring, no pressure or pain is caused to the baby.

I claim:

1. A baby's pacifier including a protection disc with a nipple attached on one side of said disc and a gripping handle attached on an other side of said disc, the improvement comprising:

clip means on said protection disc for engaging the lip of the user and retaining said pacifier thereon.

2. A baby's pacifier as claimed in claim 1, characterised thereby that the clip means is subsequently ¾ (270°) of a ring.

3. A baby's pacifier as claimed in claim 1, characterised thereby that the clip is part of the protection disc.

* * * * *